US005235567A

United States Patent [19]

Goodwin

[11] Patent Number: 5,235,567

[45] Date of Patent: Aug. 10, 1993

[54] QUICK RELEASE WATCHBAND

[76] Inventor: Charles M. Goodwin, 1745 Old Delaware Rd., Mount Vernon, Ohio 43050

[21] Appl. No.: 985,938

[22] Filed: Dec. 4, 1992

[51] Int. Cl.[5] ..... G04B 37/00; A44C 5/14

[52] U.S. Cl. ..... 368/282; 224/175

[58] Field of Search ..... 368/281-282; 224/167-180

[56] References Cited

U.S. PATENT DOCUMENTS

| | | | |
|---|---|---|---|
| 1,139,108 | 5/1915 | Depollier . | |
| 1,204,902 | 11/1916 | Poltock . | |
| 1,739,976 | 12/1929 | Marinsky | 63/11 |
| 2,046,079 | 6/1936 | MacIntosh | 63/11 |
| 2,313,073 | 3/1943 | Hovey | 224/4 |
| 2,315,417 | 3/1943 | Greenberg | 59/79 |
| 3,073,492 | 1/1963 | Berger | 224/4 |
| 4,401,388 | 8/1983 | Mearns | 368/282 |
| 4,855,974 | 8/1989 | Steinmann | 368/282 |
| 4,905,879 | 3/1990 | Piccone | 224/173 |

*Primary Examiner*—Vit W. Miska

*Attorney, Agent, or Firm*—Jacobson, Price, Holman & Stern

[57] ABSTRACT

A watch bezel including opposite side partial strap members pivotally secured thereto. A flexible band assembly including opposite end portions is provided and the opposite end portions of the band assembly are lengthwise slidably anchored relative to the free ends of the partial strap members and bent back upon themselves. A first of the back turned portions is adjustably anchored to predetermined longitudinally spaced portions of the band and the other end portion spans the full distance between the partial strap members and is lapped over and releasably anchored to the outer side of the partial strap member remote from the strap member with which the other band portion is slidably anchored.

10 Claims, 2 Drawing Sheets

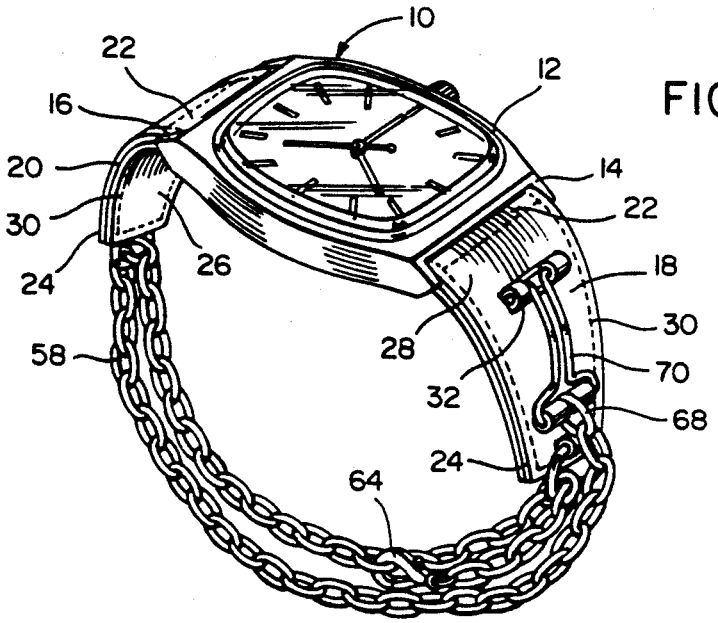
FIG. 1
FIG. 2
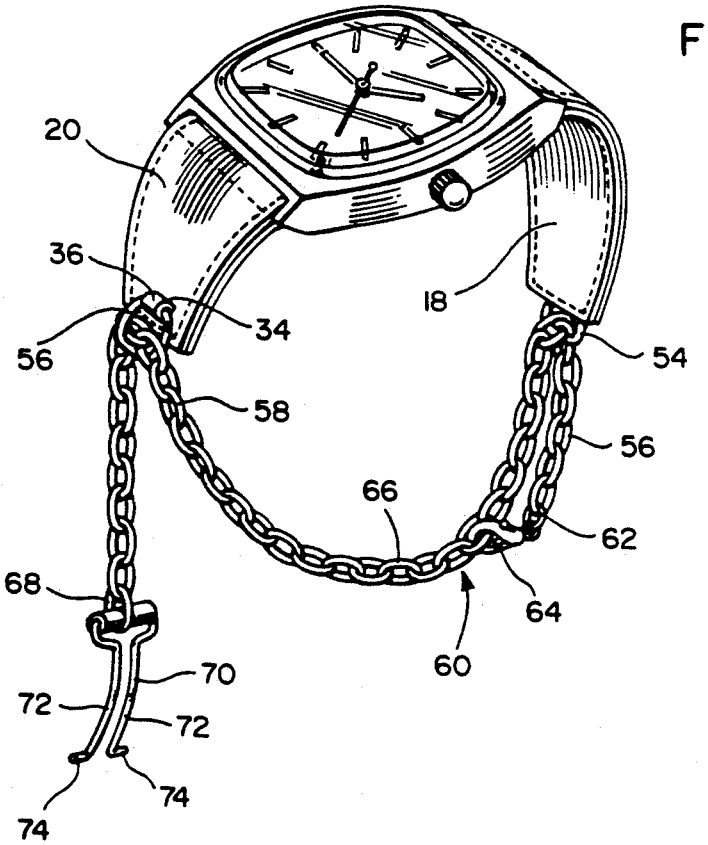
FIG. 5
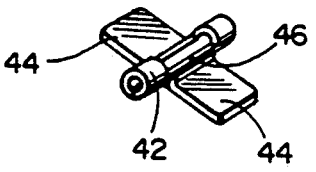
FIG. 6
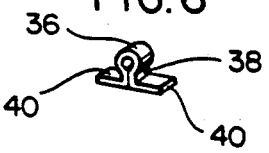

QUICK RELEASE WATCHBAND

BACKGROUND OF THE INVENTION

1. Field of the Invention

This invention relates to a watchband which includes an adjustable length, doubled midportion interposed between fixed length opposite end band structures pivotally connected to opposite sides of a wristwatch bevel and wherein the watchband midportion is anchored once to one of the opposite end band structures and twice to the other of the opposite end band structures with one of the attachments to the other end band structure being readily releasable to effect enlargement of the overall watchband construction sufficient to pass over the hand of the user.

2. Description of Related Art

Various different forms of watchbands and supports including some of the general, structural and operational features of the instant invention heretofore have been provided. Examples of these previous known structures are disclosed in U.S. Pat. Nos. 1,139,108, 1,204,902, 1,739,967, 2,046,079, 2,313,073, 2,315,417, 3,073,492 and 4,401,388.

However, these previously known forms of watchband structures and holders do not include structures which are equivalent to or function in the same manner as the instant invention.

SUMMARY OF THE INVENTION

The watchband assembly of the instant invention includes relatively short opposite end sections (which may be flexible or at least semirigid and arcuate in shape) pivotally attached to opposite sides of a watch bezel and a doubled, adjustable length intermediate band section slidably anchored relative to each opposite end section and releasably secured to one of the opposite end section in a manner such that disengagement thereof will allow expansion of the watchband assembly sufficient to pass over the hand of a user.

The main object of this invention is to provide a watchband which may be precisely adjusted in effective "closed length" and yet which may be readily released for opening to an "expanded length" for slipping over the hand of the user.

Another object of this invention is to provide a watchband assembly including an adjustable length intermediate length section which is doubled when "closed" and offers maximum strength.

Another very important object of this invention is to provide a watchband construction which may be readily adjusted for a particular wrist circumference.

Yet another important object of this invention is to provide a watchband including opposite end sections or portions which are arcuate and semirigid so as to conform more closely to wrist circumference contour.

A further object of this invention is to provide a wristwatch band whose basic structural and operational features may be incorporated either a strap type construction or a chain type construction.

A final object of this invention to be specifically enumerated herein is to provide a watchband in accordance with the preceding objects and which will conform to conventional forms of manufacture, be of simple construction and easy to use so as to provide a device that will economically feasible, long lasting and relatively trouble free in operation.

These together with other objects and advantage which will become subsequently apparent reside in the details of construction and operation as more fully hereinafter described and claimed, reference being had to the accompanying drawings forming a part herein wherein like numeral refer to like parts throughout.

BRIEF DESCRIPTION OF THE DRAWINGS

FIG. 1 is a perspective view of a conventional form of watch bezel equipped with a quick release watchband constructed in accordance with the present invention and incorporating an adjustable length link chain construction;

FIG. 2 is a perspective view illustrating the assemblage of FIG. 1 with the watchband in an "open" position;

FIG. 5 is an enlarged perspective view of the anchor member carried by a first of the anchor strap members and with which the locking clip member of the watchband is releasably engageable;

FIG. 6 is an enlarged perspective view of the anchor member carried by the second of the anchor strap members and with which a D-ring is pivotally engaged for slidably receiving on end portion of the adjustable length band assembly;

DESCRIPTION OF THE PREFERRED EMBODIMENTS

Figure 3:
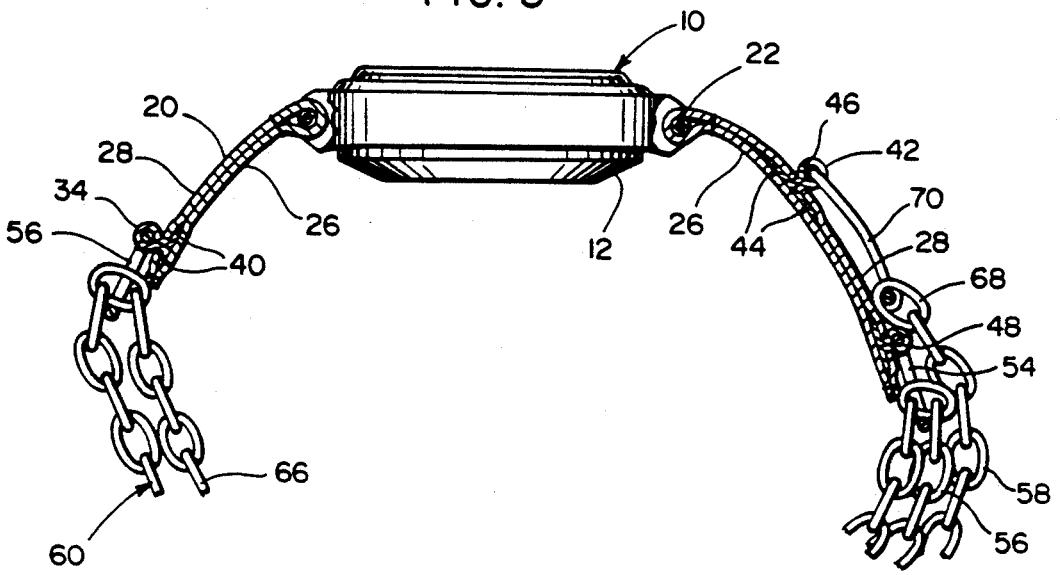
FIG. 3 is an enlarged fragmentary sectional view of the portions of the assemblage illustrated in FIG. 1 adjacent the associated watch bezel.
Figure 4:
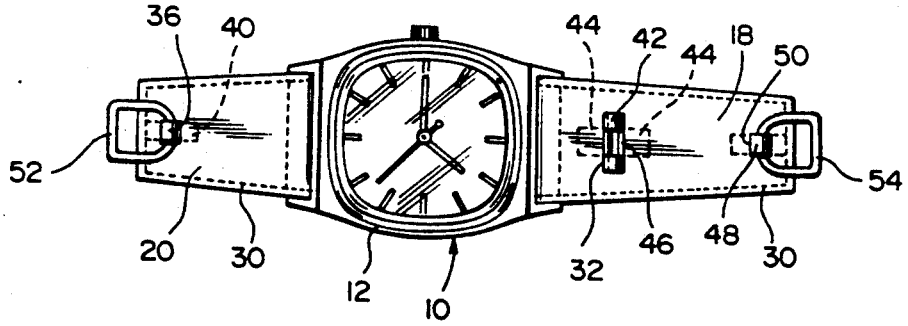
FIG. 4 is a plan view of the watchbezel illustrated in FIGS. 1-3 with the anchor straps members of the quick change watchband, only, illustrated in operative association therewith.

Referring now more specifically to FIGS. 1-6, the reference numeral 10 generally designates a wristwatch which has been modified in accordance with the present invention. The wristwatch 10 includes a conventional bezel 12 having first and second anchor locations 14 and 16 on opposite sides thereof. In addition, a pair of semirigid anchor strap members 18 and 20 are provided and include base and free ends 22 and 24. The anchor strap members also include inner and outer sides 26 and 28 and have their base ends 22 pivotally anchored from the anchor locations 14 and 16 through utilization of the conventional strap attaching pins (not shown).

The anchor strap members 18 and 20 each comprise a flexible strap member which is bent back upon itself at the base end 22 thereof and stitched as at 30. The anchor strap members 18 and 20 are interiorally reinforced through the utilization of semirigid strips (not shown) confined within the boundaries of the stitching 30 and the outer layer of the anchor strap member 18 is provided with a window 32 while the outer layer of the strap member 20 is provided with a window 34. A closed anchor eye 36 is supported from the strap member 20 in the manner shown in FIGS. 2 and 4 with a shank portion 38 extending through the window 34 and terminating inwardly in oppositely directed flange portions 40 disposed between the inner and outer layers of the anchor strap member 20. In addition, a notched anchor eye 42 projects through the window 32 and is equipped with oppositely directed flange portions 44 held captive between the inner and outer layers of the anchor strap member 18, the anchor eye 42 including a laterally opening notch 46 for purpose to be hereinafter more fully set forth.

Also, the free end of the anchor strap member 18 includes a second anchor eye 48 which is substantially identical to the anchor eye 36 carried by the anchor strap member 20, the anchor eye 48 being received through a corresponding window 50 formed in the outer layer of the anchor strap member 18.

The anchor eyes 36 and 48 pivotally support D-rings 52 and 54, respectively, therefrom and first and second end portions 56 and 58 of an adjustable length band assembly referred to in general by the reference numeral 60 are slidably received through the first and second D or anchor rings 52 and 54. The band assembly first end portion 56 includes a terminal end 62 equipped with a clasp hook 64 which may be selectively engaged with any one of the links 66 which comprise the chain-type band assembly 60. In addition, the second end portion 58 includes a terminal end 68 equipped with a spring-type locking clip 70 incorporating a pair of spring arms 72 having out turned terminal ends 74. As can be seen from FIGS. 1 and 2, the effective length of the band assembly 60 may be adjusted by predetermining the link 66 with which the clasp hook 64 is releasable engaged. Thereafter, the portion of the end portion 58 which projects through the second ring 56 and supports the locking clips 70 therefrom is pulled over toward the anchor strap member 18 and the free ends of the spring arms 72 are pushed or squeezed together to thereby reduce the distance between the terminal ends 74 and to enable the latter to be received through the notch 46 in the anchor eye 42, after which the spring arms 72 are released and the terminal ends 74 are seated within the opposite ends of the anchor eye 42 on opposite sides of the notch 46. In this manner, the adjusted length of the band assembly 60 is fixed.

Of course, if the band assembly is secured about a wrist supporting the watch 10, the watch may be removed merely by squeezing the free ends of the spring arms 72 adjacent the anchor eye 42 together and then displacing the terminal ends 74 outwardly of the notch 46. Because the entire length of the end portion 58 up to the locking clip 70 may then slip back through the D-ring 56, the watch 10 may then be readily slid down the wrist and over the hand of the wearer. However, whenever the watch 10 is reapplied over the hand and about the wrist of a user, it is merely necessary to again pull on the locking clip 70, squeeze the spring arms 72 together and to insert the terminal ends 74 through the notch 46 and into the anchor eye 42 before releasing the arms 72. Furthermore, if desired, the effective length of the band assembly 60 may be adjusted without releasing the locking clip 70, merely by opening the clasp hook 64 and reengaging the latter with another of the links 66.

Figure 7:
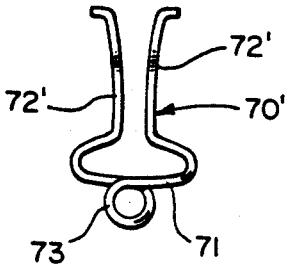
FIG. 7 is a perspective view of a second form of locking clip.

With reference now more specifically to FIG. 7 of the drawings, there may be seen a modified form of locking clip referred to in general by the reference numeral 70'. The locking clip 70' is substantially identical to the locking clip 70, except that the bight portion 71 thereof includes an integral loop 73 to enable a greater springing action to be exerted on the support arms 72' of the locking clip 70'.

Figure 8:
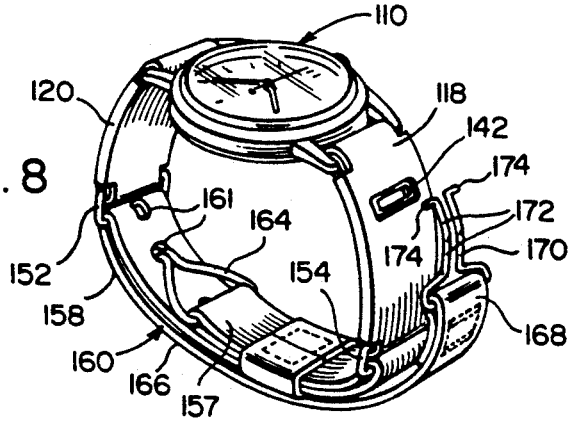
FIG. 8 is a perspective view of a modified form of the invention utilizing an adjustable length band assembly in the form of a strap assembly as opposed to the chain link assembly illustrated in FIGS. 1-3.

With attention now invited more specifically to FIG. 8, the reference numeral 110 generally designates modified form of watch. The watch 110 includes anchor strap members 118 and 120 corresponding to the anchor strap members 18 and 20 and anchor rings 152 and 154 corresponding to the anchor rings 54 and 56 supported from the anchor strap members 118 and 120. Further, the anchor strap member 118 also includes an anchor eye 142 corresponding to the anchor eye 42.

The watch 110 includes a band assembly referred to in general by the reference numeral 160 and including first and second end portions 156 and 158 corresponding to the end portions 56 and 58.

The band assembly 160 comprises a strap member 166 and the end portions 156 and 158 are slidably engaged with the rings 152 and 154. Further, the strap member 166 includes spaced openings 161 in which an anchor member 164 carried by the end portion 157 is selectively anchorably engageable for adjusting the effective length of the band assembly 160 and the end portion 158 includes a terminal end 168 corresponding to the terminal end 68 from which a locking clip 170 corresponding to the locking clip 70 is supported, the locking clip 170 also including outwardly directed terminal ends 174 on the free ends of its spring arms 172. Of course, the terminal ends 174 are releaseably engageable in the opposite ends of the anchor member 142 corresponding to the anchor member 42 in the same manner in which the terminal ends 74 are engageable in the opposite ends of the anchor member 42.

Thus, the overall operation of the band assembly 160 is substantially identical to the operation of the band assembly 60.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. In a wristwatch having a bezel and first and second anchor locations on opposite sides of said bezel, a pair of anchor strap members including inner and outer sides and corresponding base and free ends, means pivotally anchoring said base ends to said anchor locations for swinging about generally parallel axis normal to a straight path extending between said anchor locations, said free ends including first and second anchor rings mounted therefrom, and adjustable length band assembly including an elongated flexible member having first and second end portions including first and second terminal ends, respectively, said first end portion being slidably received through said first ring and folded back upon itself, said second end portion being slidably received through said second ring and folded back upon itself with the remainder of said band assembly extending between said rings, said second terminal end being at least partially endwise lapped over the outer side of said first anchor strap member free end and releasably anchored thereto, said first terminal end including first anchor means and said first end portion including second anchor means spaced therealong, said first anchor means being releasably anchored relative to a selected one of said second anchor means.

2. The wristwatch of claim 1 wherein said anchor strap members are semirigid with the inner and outer sides thereof concave and convex, respectively.

3. The wristwatch of claim 1 wherein said elongated flexible member comprises a link chain section.

4. The wristwatch of claim 1 wherein said elongated flexible member comprises a strap member.

5. The wristwatch of claim 1 wherein said free end of said first anchor strap member includes an anchor member supported therefrom and accessible from the outer side thereof, said second terminal end including a locking member supported therefrom and releasably engaged with said anchor member.

6. The wristwatch of claim 5 wherein said anchor member includes an elongated, centrally notched transfer eye member and said locking member includes a pair of generally parallel spring arms having free ends equipped with out turned terminal ends releaseably engaged in the opposite ends of said transversed eye member through the central notch thereof.

7. The wristwatch of claim 6 wherein said elongated flexible member comprises a link chain section.

8. The wristwatch of claim 6 wherein said elongated flexible member comprises a strap member.

9. The wristwatch of claim 8 wherein said second anchor means includes a plurality of apertures formed through said second end portion at points spaced therealong, said first anchor means including a clasp hook releasably engaged through one of said apertures.

10. In a wristwatch having a bezel and first and second anchor locations on opposite sides thereof, a pair of anchor strap members including inner and outer sides and corresponding base and free ends, means pivotally anchoring said base ends to said anchor locations for swinging about generally parallel axis normal to a straight path extending between said anchor locations, and adjustable length band assembly including an elongated flexible member having first and second end portions, said first end portion being slidingly anchored relative to the free end of said first anchor strap member and folded back upon itself, said second end portion being slidingly anchored relative to said free end of said second anchor strap member and folded back upon itself with the remainder of said band assembly extending between said anchor strap member free ends, the terminal ends of said second end portion being at least partially endwise lapped over the outer side of said first anchor strap member and releasably anchored thereto, the terminal end of said first end portion including first anchor means and said first end portion including second anchor means spaced therealong, said first anchor means being releasably anchored relative to a selected one of said second anchor means.

* * * * *